US010473003B2

(12) United States Patent
Altherr et al.

(10) Patent No.: US 10,473,003 B2
(45) Date of Patent: Nov. 12, 2019

(54) VALVE DRIVE FOR AN INTERNAL COMBUSTION ENGINE

(71) Applicant: Mahle International GmbH, Stuttgart (DE)

(72) Inventors: Patrick Altherr, Stuttgart (DE); Thorsten Ihne, Stuttgart (DE); Markus Walch, Bretten (DE); Silas Raible, Stuttgart (DE)

(73) Assignee: Mahle International GmbH (DE)

( * ) Notice: Subject to any disclaimer, the term of this patent is extended or adjusted under 35 U.S.C. 154(b) by 8 days.

(21) Appl. No.: 15/942,391

(22) Filed: Mar. 30, 2018

(65) Prior Publication Data

US 2018/0283238 A1 Oct. 4, 2018

(30) Foreign Application Priority Data

Mar. 31, 2017 (DE) ..... 10 2017 205 572

(51) Int. Cl.
*F01L 13/00* (2006.01)
*F01L 1/047* (2006.01)
(Continued)

(52) U.S. Cl.
CPC ..... *F01L 13/0005* (2013.01); *F01L 1/047* (2013.01); *F01L 1/18* (2013.01); *F01L 1/181* (2013.01);
(Continued)

(58) Field of Classification Search
CPC ... F01L 1/047; F01L 2001/0473; F01L 1/053; F01L 1/181; F01L 1/46; F01L 13/0036; F01L 2013/0052
(Continued)

(56) References Cited

U.S. PATENT DOCUMENTS 5,129,407 A 7/1992 Phillips
2011/0240892 A1* 10/2011 Nendel ..... F01L 1/047 251/129.01
(Continued)

FOREIGN PATENT DOCUMENTS

DE 19945340 A1 3/2001
DE 102010049709 B3 4/2012
(Continued)

OTHER PUBLICATIONS

English abstract for DE-202015009047.
(Continued)

*Primary Examiner* — Jorge L Leon, Jr.
(74) *Attorney, Agent, or Firm* — Fishman Stewart PLLC

(57) ABSTRACT

A valve drive for an internal combustion engine may include a cam shaft, at least one cam follower, and at least one adjusting device. The at least one adjusting device may include a first adjustable engagement element and a second adjustable engagement element. The first engagement element may not contact a first guide in an initial position, and may cooperate with the first guide in a switching position. The second engagement element may not contact a second guide of a slide guide in an initial position, and may cooperate with the second guide in a switching position. The at least one adjusting device may further include a switching arrangement that may include a first control element mounted to the first engagement element and a second control element mounted to the second engagement element. The first control element and the second control element may be controllable via the switching arrangement.

20 Claims, 4 Drawing Sheets

(51) Int. Cl.
*F01L 1/18* (2006.01)
*F01L 1/053* (2006.01)
*F01L 1/20* (2006.01)

(52) U.S. Cl.
CPC ..... *F01L 13/00* (2013.01); *F01L 13/0036* (2013.01); *F01L 1/053* (2013.01); *F01L 1/20* (2013.01); *F01L 2013/101* (2013.01); *F01L 2013/103* (2013.01); *F01L 2013/105* (2013.01); *F01L 2013/106* (2013.01); *F01L 2105/00* (2013.01)

(58) Field of Classification Search
USPC ..... 123/90.16, 90.17, 90.18, 90.21, 90.27
See application file for complete search history.

(56) References Cited

U.S. PATENT DOCUMENTS

2013/0047944 A1* 2/2013 Schwarzenthal ..... F01L 1/047 123/90.18
2014/0190432 A1* 7/2014 McConville ..... F01L 1/22 123/90.17
2015/0101552 A1* 4/2015 Choi ..... F01L 13/0036 123/90.15
2016/0071640 A1* 3/2016 Kato ..... F02D 13/0207 335/229
2016/0125990 A1* 5/2016 Strigerwald ..... F01L 13/0036 335/229
2016/0125991 A1* 5/2016 Wardle ..... F01L 13/0036 335/232
2016/0265397 A1* 9/2016 Schulz ..... F01L 13/0015
2017/0152773 A1* 6/2017 Choi ..... F01L 13/0042
2017/0284240 A1* 10/2017 Takada ..... F01L 1/053
2017/0284241 A1* 10/2017 Kataoka ..... F01L 1/022
2018/0100414 A1* 4/2018 Gallon ..... F01L 1/047
2018/0283227 A1* 10/2018 Douglas ..... F01L 13/0036

FOREIGN PATENT DOCUMENTS

DE 102014212305 A1 1/2015
DE 202015009047 U1 8/2016
EP 1408203 A2 4/2004
GB 2256554 A 12/1992

OTHER PUBLICATIONS

English abstract for DE-102014212305.
English abstract for DE-102010049709.
English abstract for DE-19945340.

* cited by examiner

VALVE DRIVE FOR AN INTERNAL COMBUSTION ENGINE

CROSS-REFERENCE TO RELATED APPLICATIONS

This application claims priority to German Patent Application No. DE 10 2017 205 572.3, filed on Mar. 31, 2017, the contents of which are hereby incorporated by reference in its entirety.

TECHNICAL FIELD

The invention relates to a valve drive for an internal combustion engine comprising a cam shaft and comprising at least one cam follower.

BACKGROUND

Generic valve drives for an internal combustion engine comprising a cam shaft and comprising at least one cam follower as well as comprising at least one cam group, which is mounted to the cam shaft in a rotatably fixed manner, comprising a first cam and comprising a second cam axially adjacent to the first cam, are already known. In a first position, the cam follower is thereby drivingly connected to the first cam of the respective cam group and, in a second position, to the second cam of the respective cam group.

The cam follower can be switched between the first position and the second position by means of an adjusting device and can thus switch on or switch off a corresponding cylinder of the internal combustion engine. The adjusting device thereby has a first adjustable engagement element and a second adjustable engagement element, which cooperate with a respective guide, which is arranged on the cam shaft. The first guide and the second guide are thereby arranged on a slide guide, which is arranged laterally on the cam groups on the cam shaft. The first engagement element and the second engagement element are thereby adjusted between an initial position and a shifting position, whereby there is no contact with the corresponding guide in the initial position, and the respective engagement element cooperates with the corresponding guide in the switching position.

Conventionally, the respective engagement elements are adjusted individually by means of linear actuators and the valve drive is controlled in this way, which, however, requires a large control effort. As a whole, the total costs of the valve drive are also increased significantly by means of relatively expensive linear actuators. However, a more cost-efficient mechanical control of the engagement elements can only be realized with difficulty due to a narrower valve drive chamber.

SUMMARY

It is thus the object of the invention to specify an alternative space-saving embodiment for a valve drive of the generic type, in which the control of the valve drive is simplified, and the total costs are reduced.

According to the invention, this object is solved by means of the subject matter of independent claim(s). Advantageous embodiments are the subject matter of the dependent claim(s).

The present invention is based on the general idea of controlling the first engagement element and the second engagement element by means of an individual actuator and to thus reduce the number of the actuators in a valve drive.

For this purpose, the valve drive according to the invention has a cam shaft and at least one cam follower, wherein the cam shaft has at least one cam group, which is mounted to the cam shaft in a rotationally fixed manner, comprising a first cam and comprising a second cam axially adjacent to the first cam. In a first position, the respective cam follower is drivingly connected to the first cam of the respective cam group and, in a second position, to the second cam of the respective cam group. To adjust the cam follower into the first or into the second position, the valve drive has at least one adjusting device, which has a first adjustable engagement element and a second adjustable engagement element. The first engagement element thereby cooperates with a first guide, which is arranged on the cam shaft, and the second engagement element cooperates with a second guide of a slide guide, which is arranged on the cam shaft. The first guide and the second guide can thereby be mounted to a slide guide. The first engagement element and the second engagement element can alternately be adjusted between an initial position and a switching position, whereby there is no contact with the corresponding guide in the initial position, and the respective engagement element cooperates with the corresponding guide in the switching position. According to the invention, the adjusting device has a switching arrangement comprising a first control element and comprising a second control element. The first control element is thereby mounted to the first engagement element and the second control element to the second engagement element. By means of the switching arrangement, the first control element comprising the first engagement element can be controlled through a first stop area, and the second control element comprising the second engagement element through a second stop area of the switching arrangement and can be adjusted from the initial position into the switching position.

The control element cooperates with the corresponding stop area of the switching arrangement. To adjust the engagement element, the corresponding stop area is guided to the control element by means of the switching arrangement, so that the control element mounted to the engagement element and thus to the cam follower, is adjusted by means of an upwards or downwards movement of the cam follower parallel to a longitudinal axis of the engagement element. The adjustment of the control element comprising the engagement element thereby occurs in that the control element bears on the stop area of the switching arrangement and is prevented from the upwards or downwards movement of the cam follower with the rocker arm on the rocker arm shaft. In response to the upwards or downwards movement of the cam follower with the rocker arm, the control element is thus adjusted relative to the cam follower. The control element thus also adjusts the engagement element along its longitudinal axis from the initial position into the switching position. The adjusted engagement element now cooperates with the respective guide, and the cam follower is transferred from the first position into the second position. The control element comprising the engagement element simultaneously also shifts along the cam follower from the respective stop area of the switching arrangement. The motion sequence of the switching arrangement can thereby be very simple—for example linear—and can be realized with a single actuator. The control elements also provide for an indirect actuation of the engagement elements and the switching arrangement can also be arranged inside a narrow valve drive chamber in a space-saving manner above or below the engagement elements. As a whole, the first engagement element and the second engagement element can be controlled by means of the switching arrangement with a single actuator in the valve drive according to the invention. The number of the actuators and thus the total costs of the valve drive are reduced in this way. In addition, the control of the valve drive is simplified as well.

In an advantageous further development of the solution according to the invention, provision is made for the adjusting device to have at least one fastening arrangement comprising a fastening element and comprising a counter fastening element, which is formed complementary to the fastening element. The control element is thereby mounted to the corresponding engagement element by means of the fastening element and the counter fastening element. A mounting of the engagement element to the respective fastening element provides for an adjustment of the engagement element from the initial position into the switching position by means of an adjustment of the control elements. The fastening element and the counter fastening element can be realized for example by means of a screw connection. A different positive connection, substance-to-substance bond or non-positive connection is possible as well.

Provision is advantageously made for the fastening element to be a through groove, which runs parallel or perpendicular to a longitudinal axis of the respective engagement element, and for the counter fastening element to be a formation, which is complementary and integral to the through groove, on the engagement element or on the control element. The through groove and the formation engage with one another in a positive manner and thus mount the fastening element to the counter fastening element. The fastening element can thus be formed on the engagement element and the counter fastening element on the control element. In the alternative, the fastening element can be formed on the control element and the counter fastening element on the engagement element.

For example, the engagement element can thus have the through groove—which is thus radial—which runs perpendicular to the longitudinal axis of the engagement element, and the control element can have the formation, which is complementary to the through groove. The formation of the control element is then arranged in the through groove of the engagement element and the control element is mounted in a positive manner parallel to the longitudinal axis of the engagement element—thus axially—in the engagement element. The through groove—and thus the control element—can thereby be arranged in a middle, lower or upper area of the engagement element, so as to provide for a space-saving and variable installation of the switching arrangement in the valve drive. The lower area is thereby defined as an area of the engagement element, which cooperates with the slide guide. In addition, provision can also be made for a stop area, which is formed around the through groove or around the formation, and which can be mounted perpendicular to the longitudinal axis of the engagement element—thus radially—to the engagement element in one direction by means of the control element. To also mount the control element in an opposite direction on the engagement element, a stop piece can be mounted to the control element. The control element is mounted perpendicular to the longitudinal axis of the engagement element—thus radially—to the latter in a positive manner by means of the stop area and the stop piece.

In the alternative, the control element can have the through groove—which is thus axial—which runs parallel to the longitudinal axis of the engagement element, and the engagement element can have the formation, which is complementary thereto. The through groove and the formation mount the control element perpendicular to the longitudinal axis of the engagement element—thus radially—to the engagement element in a positive manner. Here, the control element can also be mounted to the engagement element along the longitudinal axis of the engagement element—thus axially—by means of a stop area and a stop piece.

Provision is advantageously made for the respective control element to be s-shaped or c-shaped. The switching arrangement can then be arranged above or below as well as spaced apart on the engagement elements in a space-saving manner.

In a further development of the solution according to the invention, provision is advantageously made for the cam follower to have at least one guide recess, in which the control element is arranged so as to be capable of being displaced parallel to the longitudinal axis of the engagement element. The guide recesses in the cam follower prevent a lateral rotation of the control elements on the engagement elements, so that the engagement elements can be adjusted more securely.

Provision is also made for the slide guide to have at least one resetting arrangement, by means of which the engagement element can be brought into the initial position. It is ensured in this way that the engagement elements are in the initial position between the switch-over processes and can be controlled quickly.

Advantageously, the switching arrangement can be a pivot arrangement, wherein the first control element can be controlled by means of a pivoting of the pivot arrangement about an angle through the first stop area, and the second control element through the second stop area in an alternating manner. In the alternative, the switching arrangement can be a shifting arrangement, wherein the first control element can be controlled by means of a displacement of the shifting arrangement along a longitudinal axis of the cam follower through the first stop area, and the second control element through the second stop area, and the engagement elements can thus also be controlled in an alternating manner.

Such a switching arrangement can control the engagement elements with a very simple motion sequence, which can be realized by means of a single actuator. The number of the actuators in the valve drive and the total costs of the valve drive can be reduced in this way. Such a switching arrangement can moreover be embodied to be highly robust and mechanically stable.

Advantageously, the switching arrangement can be activated by means of an actuator, wherein the respective control elements can also be controlled by means of the activation of the switching arrangement. For example, the actuator can be a hydraulic, an electric or an electromagnetic or a pneumatic actuator. Other actuators can also be used in the switching arrangement in an advantageous manner.

Provision is advantageously made for the switching arrangement to be mounted to a cylinder head. The switching arrangement can be mounted in the valve drive without an additional space requirement in this way. The mounting can thereby occur by means of a substance-to-substance bond, in a non-positive or positive manner.

As a whole, the engagement elements can be controlled by means of the switching arrangement with a single actuator in the valve drive according to the invention. The number of the actuators and thus the total costs of the valve drive are reduced in this way and the control of the valve drive is simplified significantly. In addition, the switching arrangement can be mounted in the valve drive in a space-saving manner by means of the control elements.

Further important features and advantages of the invention follow from the subclaims, from the drawings, and from the corresponding figure description by means of the drawings.

It goes without saying that the above-mentioned features, and the features, which will be explained below, cannot only be used in the respective specified combination, but also in other combinations or alone, without leaving the scope of the invention.

Preferred exemplary embodiments of the invention are illustrated in the drawings and will be explained in more detail in the description below, whereby identical reference numerals refer to identical or similar or functionally identical components.

BRIEF DESCRIPTION OF THE DRAWINGS

In each case schematically.

DETAILED DESCRIPTION

Figure 1:
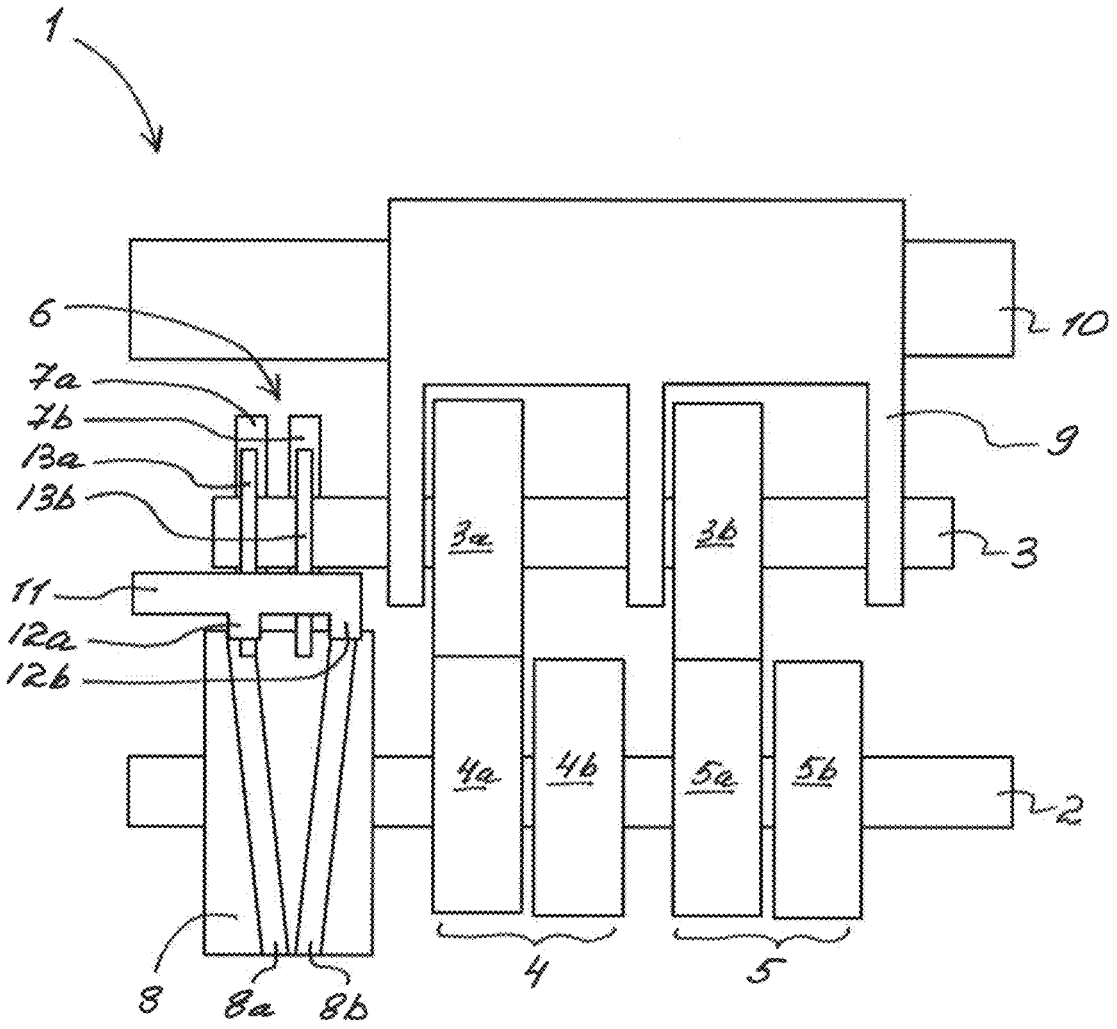
FIG. 1 shows a view of a valve drive according to the invention.

According to FIG. 1, a valve drive 1 according to the invention has a cam shaft 2 and a cam follower 3 comprising a first roller 3*a* and comprising a second roller 3*b*. The cam shaft 2 has a first cam group 4 and a second cam group 5, which are mounted to the cam shaft 2 in a rotationally fixed manner. The first cam group 4 and the second cam group 5 each have a first cam 4*a* and 5*a* as well as a second cam 4*b* and 5*b*, which is axially adjacent to the respective first cam 4*a* and 5*a*. In a first position, the rollers 3*a* and 3*b* of the cam follower 3 are drivingly connected to the first cams 4*a* and 5*a* of the cam groups 4 and 5, and in a second position, the rollers 3*a* and 3*b* of the cam follower 3 are drivingly connected to the second cams 4*b* and 5*b* of the cam groups 4 and 5.

To adjust the cam follower 3 into the first position or into the second position, the valve drive 1 has an adjusting device 6, which has a first adjustable engagement element 7*a* and a second adjustable engagement element 7*b*. The first engagement element 7*a* thereby cooperates with a first guide 8*a*, which is mounted to the cam shaft 2, and the second engagement element 7*b* cooperates with a second guide 8*b* of a slide guide 8, which is mounted to the cam shaft 2. The first engagement element 7*a* and the second engagement element 7*b* can alternately be adjusted between an initial position and a switching position, whereby there is no contact with the corresponding guide 8*a* or 8*b* in the initial position and the respective engagement element 7*a* or 7*b* cooperates with the corresponding guide 8*a* or 8*b* in the switching position. The valve drive 1 also has a rocker arm 9, on which the cam follower 3 is arranged so as to be capable of being displaced. The rocker arm 9 is rotatably mounted to a rocker arm shaft 10.

To adjust the engagement elements 7*a* and 7*b*, the adjusting device 6 has a switching arrangement 11 comprising a first stop area 12*a* for a first control element 13*a* and comprising a second stop area 12*b* for a second control element 13*b*. In this exemplary embodiment, the switching arrangement 11 is a linearly guided shifting arrangement, which is controlled by means of an individual—for example hydraulic or electromagnetic or pneumatic—actuator. In response to a displacement of the switching arrangement 11 along the rocker arm shaft 10, the stop area 12*a* or 12*b* is moved to the control element 13*a* or 13*b* and the respective control element 13*a* or 13*b* is displaced perpendicular to the rocker arm shaft 10 by means of a downwards movement of the rocker arm 9. The adjustment of the control element 13*a* or 13*b* with the respective engagement element 7*a* or 7*b* thereby occurs in that the control element 13*a* or 13*b* abuts on the stop area 12*a* or 12*b* of the switching arrangement 11 and is prevented from the upwards or downwards movement of the cam follower 3 with the rocker arm 9 on the rocker arm shaft 10. The control element 13*a* or 13*b* is thus adjusted relative to the cam follower 3 in response to the upwards or downwards movement of the cam follower 3 with the rocker arm 9.

The engagement elements 7*a* and 7*b* are mounted to the respective control elements 13*a* and 13*b* and are adjusted out of the initial position into the switching position in response to the displacement of the control elements 13*a* and 13*b*. The adjusted engagement element 7*a* or 7*b* now cooperates with the respective guide 8*a* or 8*b*, and the cam follower 3 is transferred into the first or into the second position. The control elements 13*a* and 13*b* also displace simultaneously with the engagement elements 7*a* and 7*b* with the cam follower 3 from the respective stop area 12*a* or 12*b* of the switching arrangement 11.

As a whole, the first engagement element 7*a* and the second engagement element 7*b* can be controlled by means of the switching arrangement 11 with the control elements 13 and 13*b* with a single actuator in the valve drive 1 according to the invention. The number of the actuators and thus the total costs of the valve drive 1 are reduced in this way. The switching arrangement 11 can be mounted above or below the cam follower 3 in a space-saving manner by means of the control elements 13*a* and 13*b*.

Figure 2:
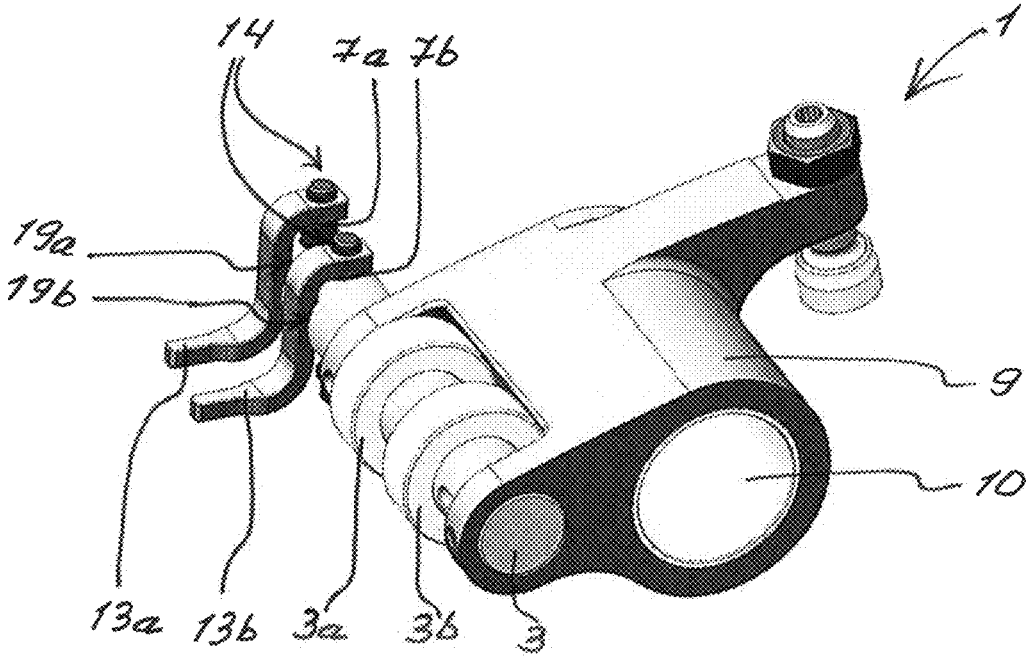
FIG. 2 shows a view of a valve drive according to the invention comprising a switching arrangement, wherein control elements have a through groove and are mounted by engagement elements in the upper area.
Figure 3:
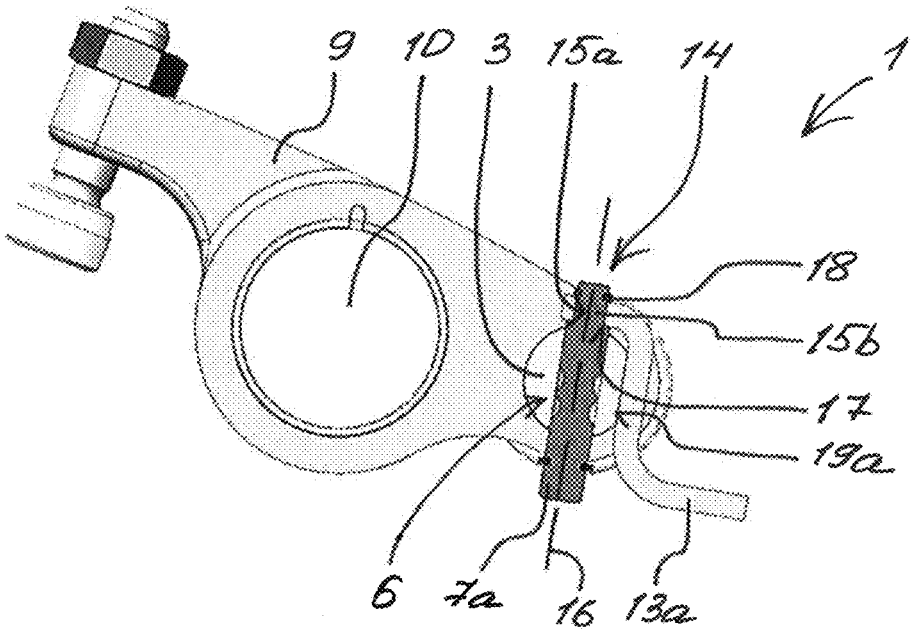
FIG. 3 shows a sectional view of the valve drive shown in FIG. 2.

FIG. 2 shows a schematic view of the valve drive 1 and FIG. 3 shows a schematic sectional view of the valve drive 1 illustrated in FIG. 2. The adjusting device 6 in each case has a fastening arrangement 14 comprising a fastening element 15*a* and comprising a counter fastening element 15*b*. The fastening element 15*a* is a through groove, which runs parallel to the longitudinal axis 16 of the respective engagement element 7*a* and 7*b*, and the counter fastening element 15*b* is a formation, which is complementary to the through groove and which is embodied in an integral manner. In this exemplary embodiment, the fastening element 15*a* is in each case mounted to the control element 13*a* and 13*b*, and the counter fastening element 15*b* is in each case mounted to the engagement element 7*a* and 7*b*. The respective control element 13*a* and 13*b* is mounted perpendicular to the longitudinal axis 16 of the respective engagement element 7*a* and 7*b*—thus radially—to the respective engagement element 7*a* and 7*b* by means of the fastening element

15*a* and the counter fastening element 15*b*. The mounting of the control elements 13*a* and 13*b* parallel to the longitudinal axis 16—thus axially—to the respective engagement element 7*a* and 7*b* is realized by means of a stop piece 17 and a stop piece 18 in this exemplary embodiment. For the control elements 13*a* and 13*b*, the cam follower 3 also has a guide recess 19*a* and 19*b* each, which prevent a lateral rotation of the control elements 13*a* and 13*b* on the engagement elements 7*a* and 7*b*.

Figure 4:
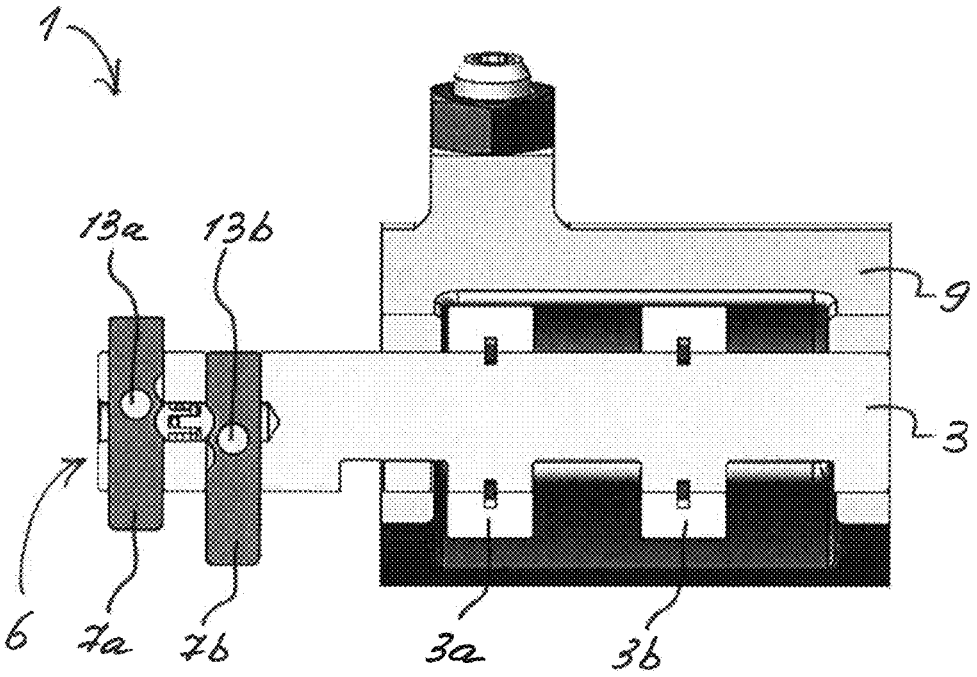
FIG. 4 shows a sectional view of a valve drive according to the invention comprising a switching arrangement, wherein control elements have a formation and are mounted by engagement elements in the middle area.
Figure 5:
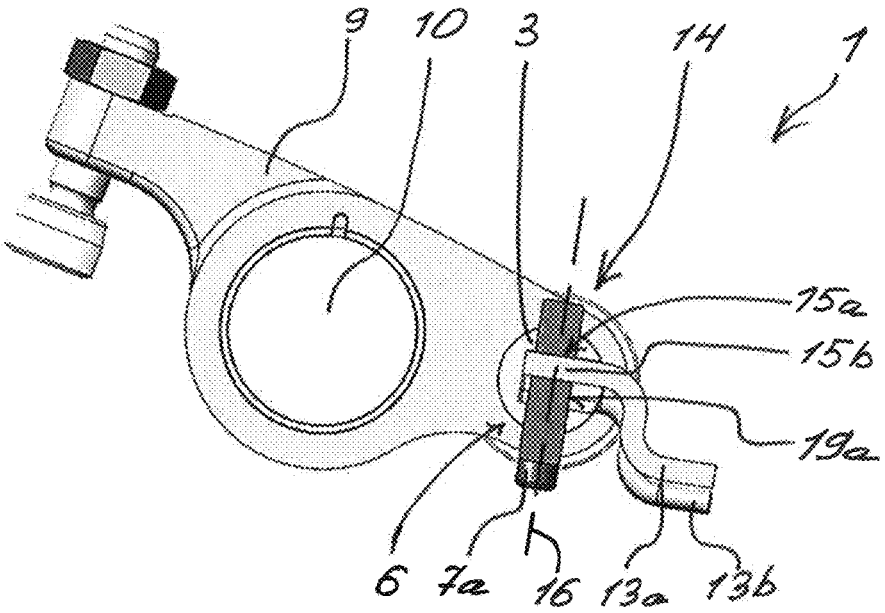
FIG. 5 shows a further sectional view of the valve drive shown in FIG. 4.

FIG. 4 shows a schematic sectional view of the valve drive 1, and a further schematic sectional view of the valve drive 1, which is illustrated in FIG. 4, comprising the alternatively embodied adjusting device 6, is shown in FIG. 5. Here, the fastening element 15*a* is a through groove, which is perpendicular—thus radial—to the longitudinal axis 16 of the respective engagement element 7*a* or 7*b*, on the respective engagement element 7*a* and 7*b*, and the counter fastening element 15*b* is an integrally embodied formation on the respective fastening element 13 and 13*b*. In this exemplary embodiment, the control elements 13*a* and 13*b* are mounted in a middle area of the respective engagement elements 7*a* and 7*b*. A lateral rotation of the control elements 13*a* and 13*b* on the engagement elements 7*a* and 7*b* is also prevented here by means of the guide recesses 19*a* and 19*b*.

Figure 6:
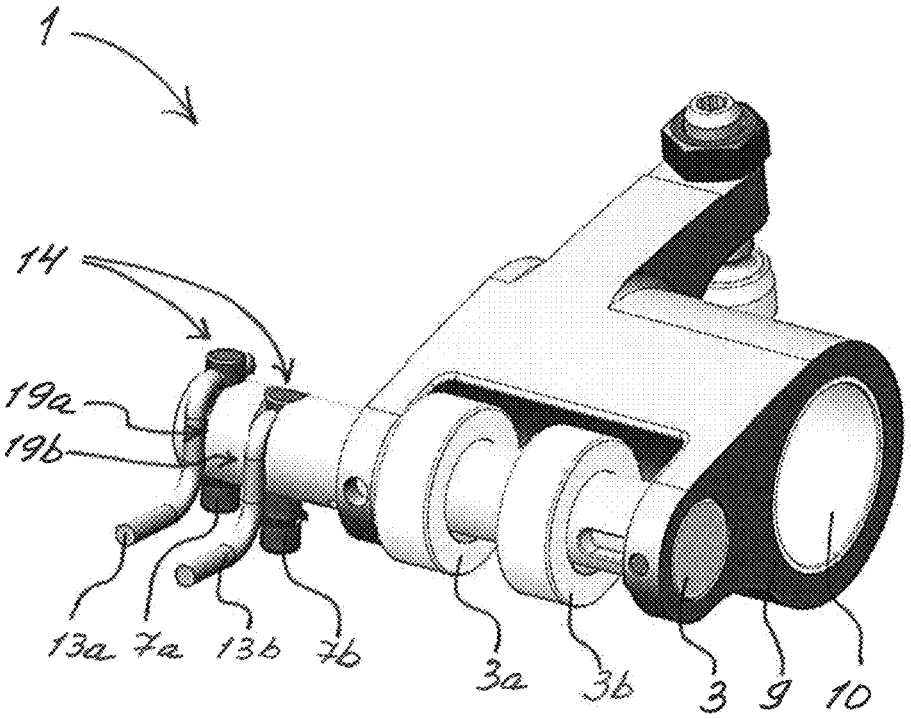
FIG. 6 shows a view of a valve drive according to the invention comprising a switching arrangement, wherein control elements have a formation and are mounted by engagement elements in the upper area.
Figure 7:
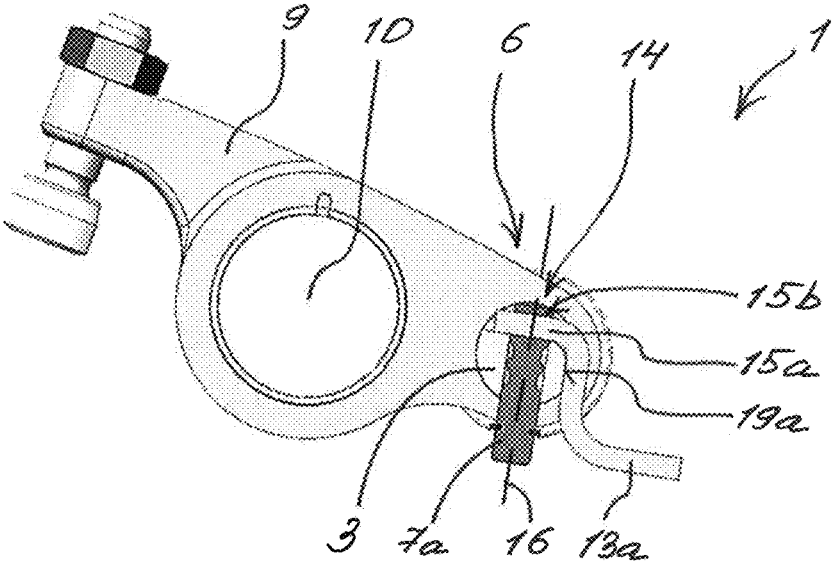
FIG. 7 shows a sectional view of the valve drive shown in FIG. 6.

FIG. 6 shows a schematic view and FIG. 7 shows a schematic sectional view of the valve drive 1 comprising the alternatively embodied adjusting device 6. In contrast to the adjusting device 6 in FIG. 4 and FIG. 5, the control elements 13*a* and 13*b* are mounted in an upper area of the respective engagement elements 7*a* and 7*b* in this exemplary embodiment.

As a whole, the engagement elements 7*a* and 7*b* can be controlled securely by means of the switching arrangement 11 with a single actuator in the valve drive 1 according to the invention. The number of the actuators and thus the total costs of the valve drive 1 can thus be reduced. The control of the valve drive 1 is also simplified significantly through this. By means of the control elements 13*a* and 13*b*, the switching arrangement 11 can additionally be mounted in the valve drive 1—for example to a cylinder head—in a space-saving manner.

The invention claimed is:

1. A valve drive for an internal combustion engine, the valve drive comprising:

a cam shaft and at least one cam follower;

the cam shaft including at least one cam group mounted to the cam shaft in a rotationally fixed manner, the at least one cam group including a first cam and a second cam disposed axially adjacent to the first cam;

the at least one cam follower being drivingly connected to the first cam when in a first position and drivingly connected to the second cam when in a second position;

at least one adjusting device including a first adjustable engagement element and a second adjustable engagement element arranged next to one another at a distance on the at least one cam follower;

the first engagement element comprising a pin cooperating with a first guide of a slide guide arranged on the cam shaft, and the second engagement element comprising a pin cooperating with a second guide of the slide guide;

wherein the first engagement element and the second engagement element alternately adjust between an initial position and a switching position;

wherein the first engagement element does not contact the first guide when in the initial position, and the first engagement element cooperates with the first guide when in the switching position;

wherein the second engagement element does not contact the second guide when in the initial position, and the second engagement element cooperates with the second guide when in the switching position;

wherein the at least one adjusting device further includes a switching arrangement including a first control element mounted to the first engagement element and a second control element mounted to the second engagement element, the first control element and the second control element each including a radially outwardly extending portion that interacts with a first stop area and a second stop area of the switching arrangement, respectively, wherein the first control element and the first engagement element are controlled via the first stop area of the switching arrangement, and the second control element and the second engagement element are controlled via the second stop area of the switching arrangement such that the first engagement element and the second engagement element adjust from the initial position to the switching position; and wherein the at least one cam follower includes at least one guide recess, in which at least one of the first control element and the second control element is arranged and guided parallel to a longitudinal axis of a corresponding one of the first engagement element and the second engagement element.

2. The valve drive according to claim 1, wherein the at least one adjusting device includes a fastener and a counter fastener structured and arranged complementary to the fastener, and wherein at least one of the first control element and the second control element are mounted to a respective one of the first engagement element and the second engagement element via the fastener and the counter fastener.

3. The valve drive according to claim 2, wherein:

the fastener is a through groove extending one of parallel and perpendicular to the longitudinal axis of the respective one of the first engagement element and the second engagement element; and the counter fastener is a formation disposed complementary and integral to the through groove, the counter fastener disposed on the at least one of the first control element and the second control element.

4. The valve drive according to claim 2, wherein one of:

the fastener is arranged on the at least one of the first control element and the second control element, and the counter fastener is arranged on e respective one of the first engagement element and the second engagement element; and the counter fastener is arranged on the at least one of the first control element and the second control element, and the fastener is arranged on the respective one of the first engagement element and the second engagement element.

5. The valve drive according to claim 2, wherein the fastener and the counter fastener are structured and arranged to provide a screw connection.

6. The valve drive according to claim 1, wherein at least one of the first control element and the second control element is one of s-shaped and c-shaped.

7. The valve drive according to claim 1, wherein the slide guide includes at least one resetting arrangement configured to adjust at least one of the first engagement element and the second engagement element into the initial position.

8. The valve drive according to claim 1, wherein the switching arrangement is structured and arranged to pivot about an angle to control the first control element through the first stop area and to control the second control element through the second stop area in an alternating manner.

9. The valve drive according to claim 1, wherein the switching arrangement is structured and arranged to shift along a longitudinal axis of the at least one cam follower to control the first control element and the second control element via a displacement through the first stop area and through the second stop area, respectively, in an alternating manner.

10. The valve drive according to claim 1, wherein the switching arrangement is activated via an actuator such that at least one of the first control element and the second control element is controlled via activation of the switching arrangement.

11. The valve drive according to claim 10, wherein the actuator is one of a hydraulic actuator, an electromagnetic actuator, and a pneumatic actuator.

12. The valve drive according to claim 1, wherein the switching arrangement is mounted to a cylinder head.

13. The valve drive according to claim 1, wherein the at least one guide recess includes a first guide recess structured and arranged to guide the first control element and a second guide recess structured and arranged to guide the second control element.

14. The valve drive according to claim 1, further comprising a rocker arm rotatably mounted on a rocker arm shaft, and wherein the at least one cam follower is operatively connected to the rocker arm.

15. The valve drive according to claim 1, wherein the switching arrangement is arranged radially between the cam shaft and the at least one cam follower relative to a rotation axis of the cam shaft.

16. A valve drive for an internal combustion engine, the valve drive comprising:

a cam shaft including at least one cam group rotationally arranged on the cam shaft, the at least one cam group including a first cam and a second cam disposed axially adjacent the first cam;

at least one cam follower being drivingly connected to the first cam when in a first position and drivingly connected to the second cam when in a second position; and at least one adjusting device including a first engagement element and a second engagement element arranged on the at least one cam follower at a distance from one another, the first engagement element comprising a pin interacting with a first guide of a slide guide arranged on the cam shaft when in a switching position and not contacting the first guide when in an initial position, the second engagement element comprising a pin interacting with a second guide of the slide guide when in the switching position and not contacting the second guide when in the initial position;

the at least one adjusting device further including a switching arrangement including a first control element mounted to the first engagement element and a second control element mounted to the second engagement element, the first control element and the second control element each including a radially outwardly extending portion that interacts with a first stop area and a second stop area of the switching arrangement, respectively;

wherein the first engagement element and the first control element are adjusted from the initial position to the switching position via the first stop area, and the second engagement element and the second control element are adjusted from the initial position to the switching position via the second stop area; and wherein the switching arrangement is structured and arranged to pivot about an angle such that the first control element is adjusted via the first stop area and the second control element is adjusted via the second stop area.

17. The valve drive according to claim 16, wherein the first control element is mounted to the first engagement element and the second control element is mounted to the second engagement element, respectively, via a fastener and a counter fastener disposed complimentary to the fastener.

18. The valve drive according to claim 17, wherein the fastener is a through groove extending parallel to a longitudinal axis of a respective one of the first engagement element and the second engagement element, and the counter fastener is a formation structured and arranged to engage with the through groove, wherein the formation is disposed complementary to the through groove on a respective one of the first control element and the second control element.

19. The valve drive according to claim 17, wherein the fastener is a through groove extending perpendicular to a longitudinal axis of a respective one of the first engagement element and the second engagement element, and the counter fastener is a formation structured and arranged to engage with the through groove, wherein the formation is disposed complementary to the through groove on a respective one of the first control element and the second control element.

20. The valve drive according to claim 19, wherein the first control element and the second control element are mounted at a longitudinal end of the first engagement element and the second engagement element, respectively.

* * * * *